US010506873B1

(12) United States Patent
Hung

(10) Patent No.: US 10,506,873 B1
(45) Date of Patent: Dec. 17, 2019

(54) TABLE STRUCTURE

(71) Applicant: Kun-Yu Hung, Taipei (TW)

(72) Inventor: Kun-Yu Hung, Taipei (TW)

(73) Assignee: Kun-Yu Hung, Taipei (TW)

( * ) Notice: Subject to any disclaimer, the term of this patent is extended or adjusted under 35 U.S.C. 154(b) by 0 days.

(21) Appl. No.: 16/198,810

(22) Filed: Nov. 22, 2018

(51) Int. Cl.

| | |
|---|---|
| ***A47B 11/00*** | (2006.01) |
| ***A47B 13/02*** | (2006.01) |
| ***A47B 31/00*** | (2006.01) |
| ***A47B 13/00*** | (2006.01) |
| ***A47F 10/06*** | (2006.01) |

(52) U.S. Cl.
CPC ..... *A47B 11/00* (2013.01); *A47B 13/003* (2013.01); *A47B 13/023* (2013.01); *A47B 31/00* (2013.01); *A47F 10/06* (2013.01); *A47B 2013/024* (2013.01); *A47B 2031/003* (2013.01); *A47B 2200/004* (2013.01); *A47B 2200/008* (2013.01); *A47B 2200/0084* (2013.01)

(58) Field of Classification Search
CPC ... A47B 11/00; A47B 2200/02; A47B 13/023; A47B 31/00; A47B 2013/024
USPC ..... 108/94, 20, 23, 50.02, 43, 44
See application file for complete search history.

(56) References Cited

U.S. PATENT DOCUMENTS 116,419 A * 6/1871 Drane ..... B64C 11/003 416/87
500,839 A * 7/1893 Anthony ..... A47B 11/00 108/94
902,955 A * 11/1908 Pike ..... A47B 13/16 108/23
1,339,525 A * 5/1920 Rod ..... A47G 19/00 108/25
1,401,057 A * 12/1921 Elliott ..... A47B 87/0223 108/101
1,570,651 A * 1/1926 Topping ..... A47F 5/04 108/94
1,790,338 A * 1/1931 CHartoff ..... A47F 5/02 108/94
2,261,514 A * 11/1941 Dunigan ..... A47B 37/00 108/23
2,488,641 A * 11/1949 Seawright ..... A47F 5/02 108/94
2,589,719 A * 3/1952 McKinney ..... A47B 11/00 108/154
2,945,597 A * 7/1960 Romano ..... F25D 25/02 108/101
3,538,862 A * 11/1970 Patriarca ..... A47B 57/485 108/144.11

(Continued)

*Primary Examiner* — Jose V Chen

(57) ABSTRACT

The present invention provides an improved table structure, which comprises: a central post, formed as a straight post and composed by plural insertion posts, the top thereof is formed with a head portion, and a power cable is provided inside the central post for being connected to a power source; a table stand, installed at the bottom of the central post, formed in a gradually expanded state; a first layer of table surface, fastened at a proper location on the central post, the center thereof is formed with a through hole; and at least two layers of rotary plates, respectively installed at the portion of the central post defined above the first layer of table surface and at a proper location on the central post defined above the lower layer of rotary plate, the center thereof is formed with a through hole corresponding to the insertion post.

7 Claims, 6 Drawing Sheets

(56) References Cited

U.S. PATENT DOCUMENTS

| | | | | | |
|---|---|---|---|---|---|
| 3,951,079 | A * | 4/1976 | Tolleson | A47F 5/02 | 108/94 |
| 4,119,834 | A * | 10/1978 | Losch | A47J 36/2483 | 108/23 |
| 4,122,956 | A * | 10/1978 | Hargrove | B25H 1/0007 | 108/28 |
| 4,815,392 | A * | 3/1989 | Soot | A47B 13/10 | 108/65 |
| 4,827,638 | A * | 5/1989 | Peters | D05C 1/04 | 108/94 |
| 5,161,561 | A * | 11/1992 | Jamieson | A45B 3/00 | 108/94 |
| 5,553,865 | A * | 9/1996 | Shoemaker, Jr. | G07F 17/3297 | 108/20 |
| 5,558,417 | A * | 9/1996 | Termotto | A47B 49/00 | 108/94 |
| 6,352,037 | B1 * | 3/2002 | Doyle | A47B 9/00 | 108/147 |
| 6,462,500 | B1 * | 10/2002 | L'Hegarat | A61G 13/02 | 318/649 |
| 6,883,673 | B1 * | 4/2005 | Gourley | A47B 11/00 | 108/94 |
| 7,975,623 | B1 * | 7/2011 | Gassick | A47G 23/0625 | 108/43 |
| 2008/0282940 | A1 * | 11/2008 | Marion | A47B 23/00 | 108/43 |
| 2013/0136829 | A1 * | 5/2013 | Kandel | A47G 19/00 | 426/132 |

* cited by examiner

TABLE STRUCTURE

BACKGROUND OF THE INVENTION

1. Field of the Invention

The present invention relates to a table, especially to an improved table structure in which at least two layers of rotary plates being installed on top of a first layer of table surface which is installed with a central post, and the rotary plate is optionally installed with an anti-slip pad, plural partition boards and a safety protection rail at the periphery, the rotary plate arranged at upper layer is installed with illumination units and optionally installed with a power sensor or a head portion of the central post is installed with a name label or an illumination unit formed in a spherical shape.

2. Description of Related Art

A conventional table structure used in a wedding, birthday party or other social occasions is often installed with a rotary plate on top of a table surface, dining wares such as bowls, plates, chopsticks, spoons, seasonings, towels are placed on the table surface where the rotary plate is not occupied, the rotary plate disposed in the center is served for accommodating big bowls or plates provided with cooked food therein, so cool food such as liquors, juices, soft drinks or teas which have already been placed on the rotary plate may be mixedly arranged with the cooked food, such arrangement is not proper for food presentation and often wasting time for looking for desired items, and when there is no free space on the rotary plate, some cold and cooked food may have to be placed in the small space defined on the table surface where the rotary plate is not occupied, so the table surface which have already been placed with the dining wares such as bowls, plates, chopsticks, spoons, seasonings and towels becomes more crowded, guests would have to pass food to each other, and no matter the cold food being placed on the rotary plate of the cooked food or the cold food being placed on the smaller table surface where the rotary plate is not occupied, items are packed within a limited space which cause trouble when guests wants to get food, and accidents such as items falling or the cold food and the cooked food being spilled may occur; moreover, the illumination for the rotary plate and the table surface is only provided by the lamps installed on the ceiling, and no illumination unit is installed closely for providing illumination and lighting decoration, thereby not being able to increase the freshness looking of the cold and cooked food and the dining atmosphere; furthermore, the conventional rotary plate is not equipped with the function of automatic rotating thereby not being to be automatically stopped when guests want to get food, so it is not convenient in use; the mentioned disadvantages are the issues that skilled people in the art want to solve, so how to design a structure allowing the cold food and the cooked food to be respectively placed on different layers of rotary plates for providing more space on the first layer of table surface, and to prevent the accidents of dining wares being abutted against each other or being broken due to overly packed space and the cold and the cooked food being spilled, and the rotary plate is installed with illumination units for providing lighting and optionally installed with at least a power sensor thereby increasing the freshness looking of the cold and cooked food and the dining atmosphere and provide an automatic stopping function when guests want to get food, and the at least two layers of rotary plates optionally installed with the anti-slip pad, the plural partition boards and the safety protection rail at the periphery can be detached at any desired time and installed with a sleeve ring or a roller, thereby saving labor for operating, and the top and the bottom of the central post is installed with a power cable for being connected to a power source from the ceiling or the floor; accordingly, an improved table structure capable of effectively solving the mentioned disadvantages is provided.

SUMMARY OF THE INVENTION

One primary objective of the present invention is to provide an improved table structure, in which the cold and the cooked food being respectively placed on different layers of rotary plates, so space on the first layer of table surface is increased, thereby getting food being more easily and accidents such as items falling or the cold food and the cooked food being spilled being prevented.

Another objective of the present invention is to provide an improved table structure, in which the top and the bottom and the periphery of a rotary plate are installed with illumination units thereby providing close lighting to the cold and the cooked food for enhancing the freshness looking of the cold and the cooked food and the dining atmosphere.

One another objective of the present invention is to provide an improved table structure, in which the bottom of a rotary plate is optionally installed with at least a power sensor thereby providing an automatic stopping function for getting food.

Still one another objective of the present invention is to provide an improved table structure, in which the top and the bottom of a central post being installed with a power cable for being connected to a power source from the ceiling or the floor thereby facilitating the power supply.

Still one another objective of the present invention is to provide an improved table structure, in which at least two layers of rotary plates being able to be detached at any desired time and installed with a sleeve ring or a roller thereby saving labor for operating.

The problem aimed to be solved by the present invention is that a conventional table structure used in a wedding, birthday party or other social occasions is often installed with a rotary plate on top of a table surface, the rotary plate disposed in the center is served for accommodating big bowls or plates provided with cooked food therein, so cool food such as liquors, juices, soft drinks or teas which have already been placed on the rotary plate may be mixedly arranged with the cooked food, such arrangement is not proper for food presentation and often wasting time for looking for desired items, and when there is no free space on the rotary plate, the cool food such as liquors, juices, soft drinks or teas may have to be placed on the table surface where the rotary plate is not occupied, so the table surface which have already been placed with the dining wares such as bowls, plates, chopsticks, spoons, seasonings and towels become more crowded, guests would have to pass food to each other, so items are packed within a limited space which cause trouble when guests wants to get food, and accidents such as items falling or the cold food and the cooked food being spilled may occur; moreover, the illumination for the rotary plate and the table surface is only provided by the lamps installed on the ceiling, and no illumination unit is installed closely for providing illumination and lighting decoration, thereby not being able to increase the freshness looking of the cold and cooked food and the dining atmosphere; furthermore, the conventional rotary plate is not equipped with the function of automatic rotating thereby not being to be automatically stopped when guests want to get food, so it is not convenient in use.

For achieving the objectives mentioned above, the present invention provides an improved table structure, which comprises:

a central post, formed as a straight post and the top thereof is formed with a head portion, the central post is composed by plural insertion posts, the top of the insertion post is formed with a protrusion part allowing an adjacent insertion post to be inserted and connected, the interior of the insertion post and the protrusion part are respectively formed with a penetrated through hole, and a power cable is provided inside the central post thereby being enabled to be connected to a power source form the top or the bottom;

a table stand, installed at the bottom of the central post, formed in a gradually expanded state;

a first layer of table surface, fastened at a proper location on the central post, the center thereof is formed with a through hole;

at least two layers of rotary plates, respectively installed at the portion of the central post defined above the first layer of table surface and at a proper location on the central post defined above the lower layer of rotary plate, the center of the rotary plate is formed with a through hole corresponding to the insertion post.

Furthermore, according to the present invention, the interior of the through hole formed at the center of the rotary plate is installed with a sleeve ring or a roller.

Furthermore, according to the present invention, the rotary plate is optionally installed with an anti-slip pad and plural partition boards and installed with a safety protection rail at the periphery.

Preferably, according to the present invention, the rotary plate is a manually-rotated plate.

Preferably, according to the present invention, the rotary plate is an electrically-rotated plate electrically connected to the power cable of the central post.

Furthermore, according to the present invention, the bottom of the rotary plate is installed with at least a power sensor which is connected to the power cable, thereby providing an automatic sensing and stopping function to the electrically-rotated plate.

Preferably, according to the present invention, the power sensor is an infrared power sensor.

Furthermore, according to the present invention, the plural illumination units are connected with the power cable and optionally installed on the top or the bottom or both of the top and the bottom or the periphery of the rotary plate or the head portion of the central post for providing illumination on dishes or providing a light changing effect for decoration or projection.

Furthermore, according to the present invention, the head portion of the central post is installed with a name label, the name label can be used for displaying the name of the person who is celebrating his/her birthday or the names of the groom and the bride.

Preferably, according to the present invention, the illumination unit installed at the head portion of the central post is formed in a spherical shape having a motor therein for providing a rotating function.

With the improved table structure provided by the present invention, the cool food such as liquor, juices and soft drinks and the cooked food placed on the first layer of table surface can be separately placed on different layers of rotary plates, the dining wares and the cold and the cooked food do not have to all be placed on the first layer of table surface and the second layer of rotary plate, thereby providing with more unoccupied space, thereby preventing the dining wares, the cold and cooked food from being crowdedly arranged against each other which may causes accidents such as items falling; the rotary plate is installed with the illumination unit for providing illumination to the cold and cooked food or providing the light changing effect and increasing the freshness looking of the cold and the cooked food and decoration; the at least two layers of rotary plates optionally installed with the anti-slip pad and the plural partition boards and the safety protection rail at the periphery can be detached at any desired time with respect to the loaded weight and installed with the sleeve ring or the roller thereby saving labor for operating; and the top and the bottom of the central post are installed with the power cable for being connected to a power source from the ceiling or the floor; and the bottom of the rotary plate above the second layer can be optionally installed with the infrared power sensor, the rotary plate installed below can be sensed and automatically stopped when guests want to get food, thereby effectively increasing the convenience in use, and being novel in design, and practical in application

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

The accompanying drawings are included to provide a further understanding of the invention, and are incorporated in and constitute a part of this specification. The drawings illustrate embodiments of the invention and, together with the description, serve to explain the principles of the invention. The accompanying drawings are only served for illustration; in actual practice, the relative ratio and precision arrangement of disclosed components and the scope of the present invention shall not be limited to the provided drawings.

Figure 1:
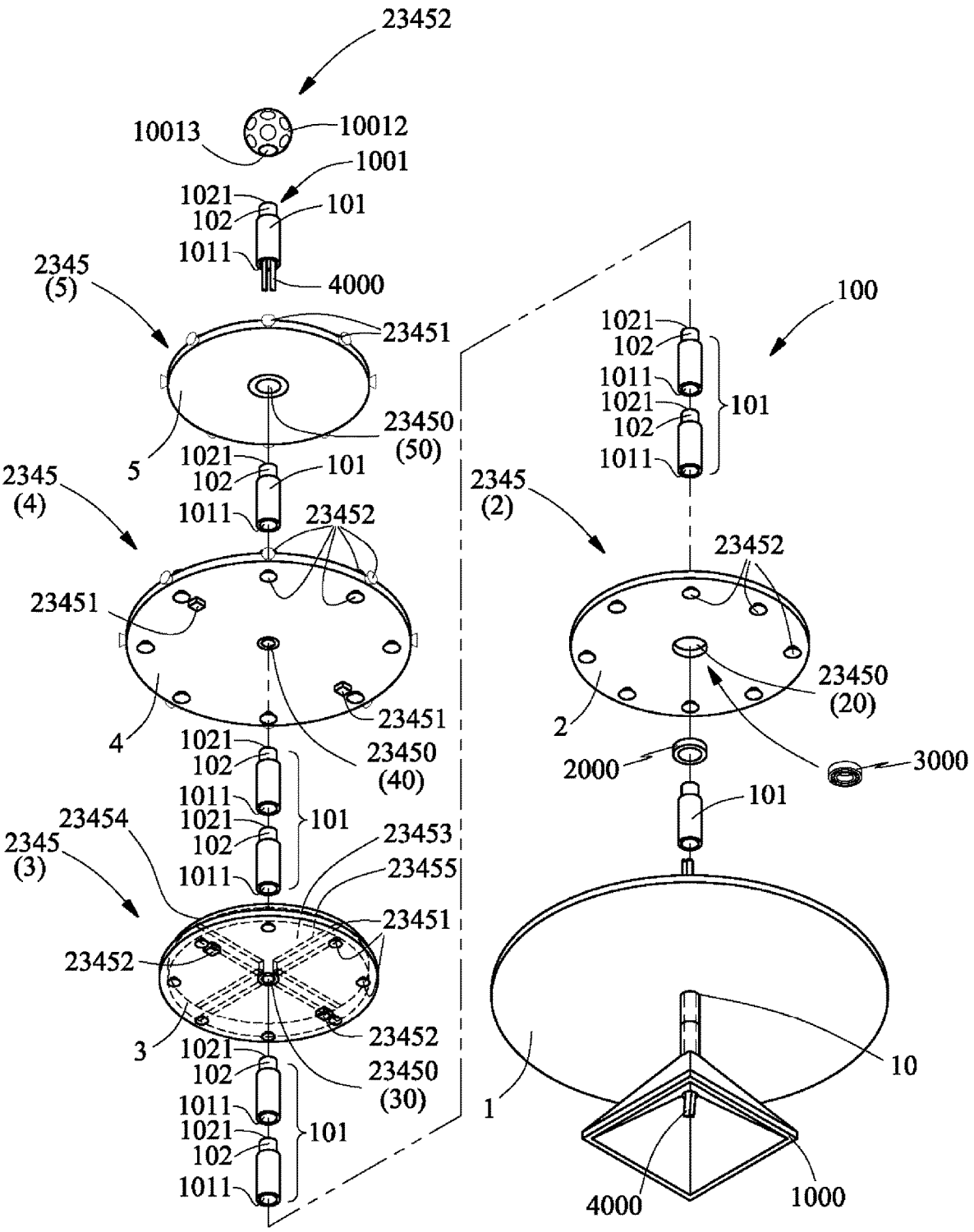
FIG. 1 is a perspective exploded view according to the present invention.
Figure 2:
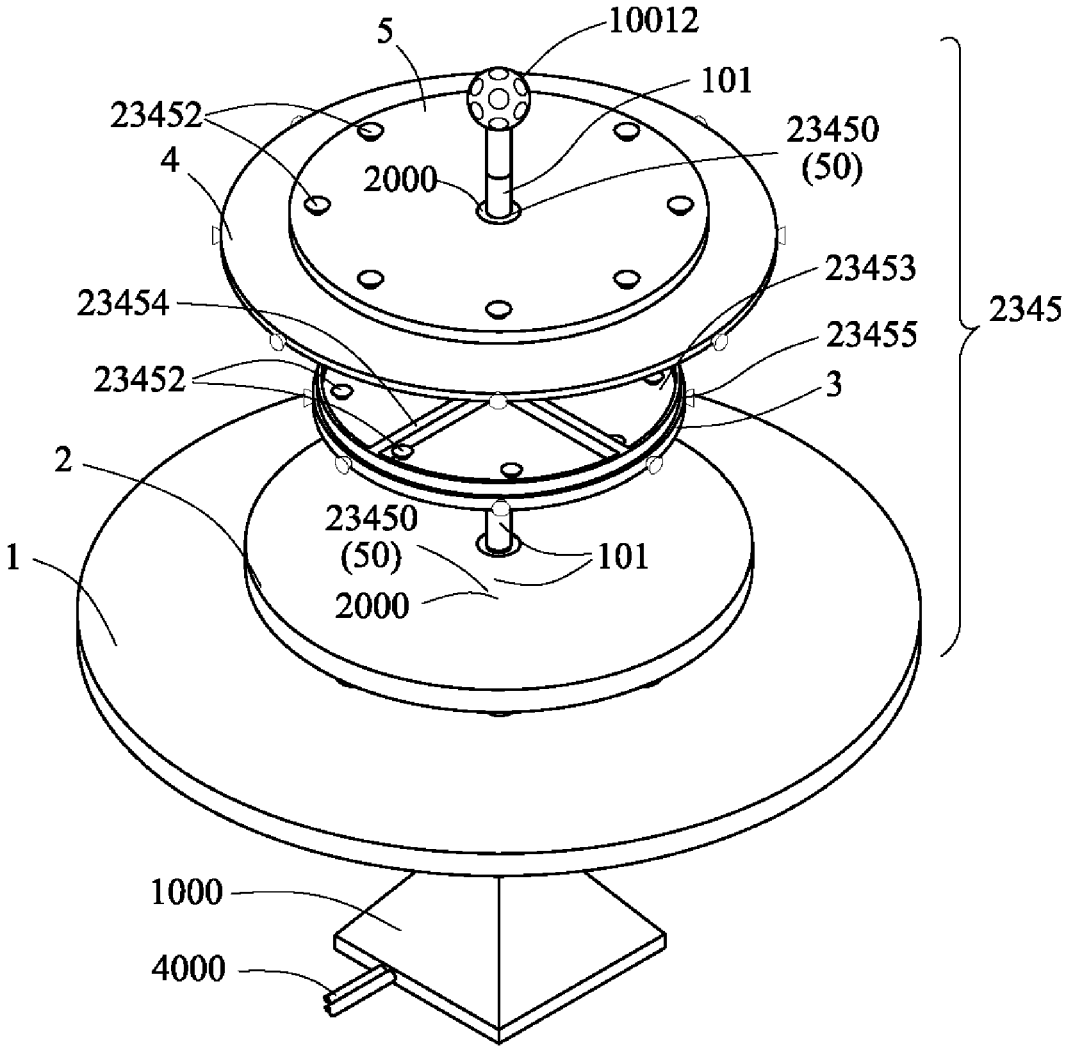
FIG. 2 is a perspective view showing the assembly according to the present invention.
Figure 3:
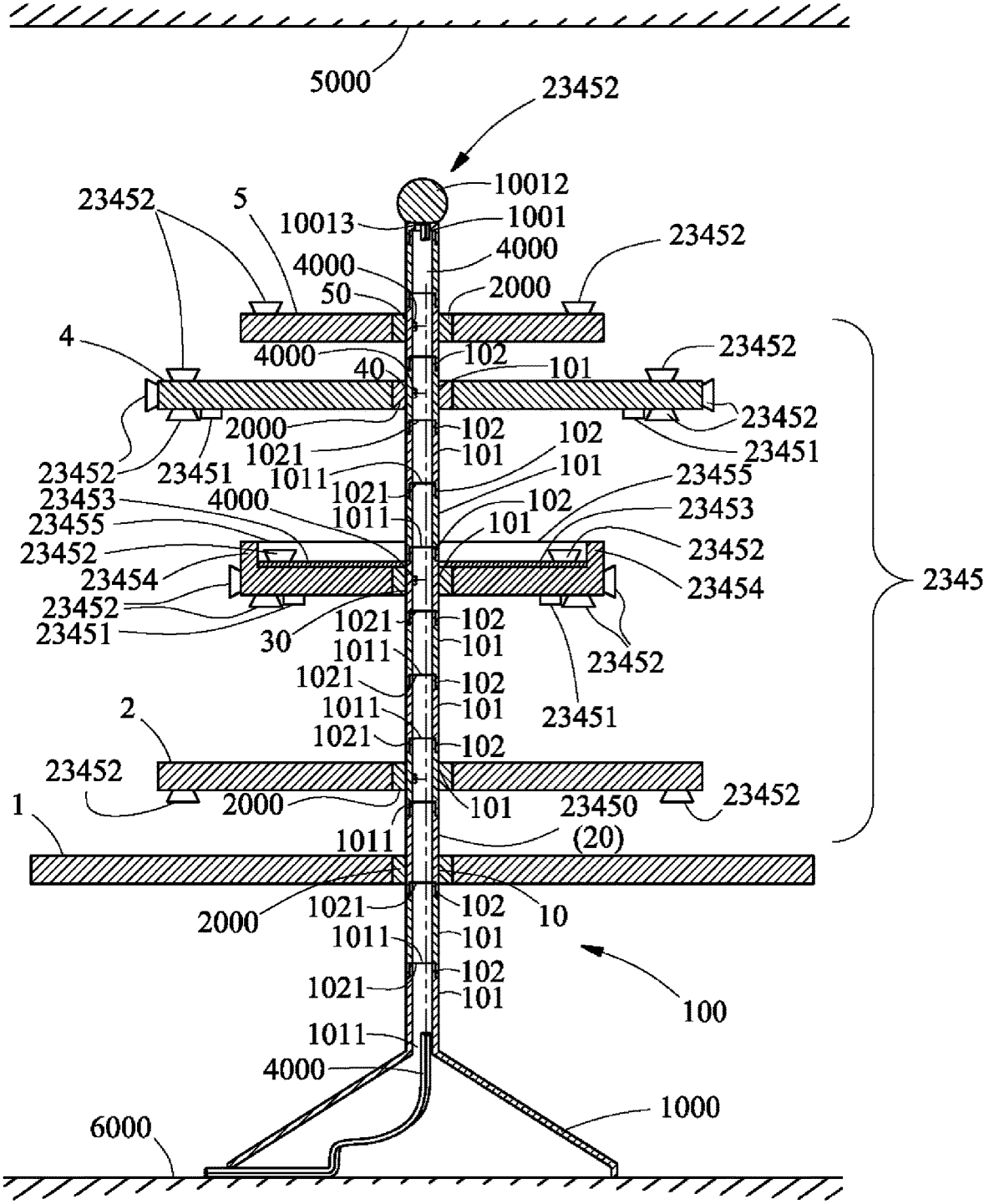
FIG. 3 is a cross sectional view showing the assembly according to the present invention.

Referring from FIG. 1 to FIG. 3, wherein FIG. 1 is a perspective exploded view according to the present invention; FIG. 2 is a perspective view showing the assembly according to the present invention; and FIG. 3 is a cross sectional view showing the assembly according to the present invention. According to one preferred embodiment of the present invention, the improved table structure comprises a central post 100, a table stand 1000, a first layer of table surface 1, at least two layers of rotary plates 2345, at least a power sensor 23451 and plural illumination units 23452.

The central post 100 is formed as a straight post and the top thereof is formed with a head portion 1001, the central post 100 is composed by plural insertion posts 101, the top of the insertion post 101 is formed with a protrusion part 102 allowing an adjacent insertion post 101 to be inserted and connected, the interior of the insertion post 101 and the protrusion part 102 are respectively formed with a penetrated through hole 1011, 1021, and a power cable 4000 is provided inside the central post 100 thereby being enabled to be connected to a power source from the ceiling 5000 and the floor 6000.

The table stand 1000 is installed at the bottom of the central post 100, according to this embodiment, the table stand 1000 is formed in a gradually expanded state, and the shape of the table stand 1000 can also be formed in a conical shape, what shall be address is that the gradually expanding state and the conical shape are only provided for illustration, rectangular, square or other shapes are all within the scope of the present invention.

The first layer of table surface 1 is fastened at a proper location on the central post 100 and the center thereof is formed with a through hole 10.

The at least two layers of rotary plates 2345 are respectively installed at the portion of the central post 100 defined above the first layer of table surface 1 and at a proper location on the central post 100 defined above the lower layer of rotary plate, the center of the rotary plate 2345 is formed with a through hole 23450 corresponding to the insertion post 101 of the central post 100, and the through hole 23450 of the rotary plate 2345 can be installed with a sleeve ring 2000 or a roller 3000 with respect to the weight, furthermore, the at least two layers of rotary plates 2345 optionally installed with an anti-slip pad 23453 and plural partition boards 23455 and installed with a safety protection rail 23454 at the periphery are provided with effects of anti-slip and safety securing and can be detached at any desired time; the rotary plate 2345 can be a manually-rotated plate or an electrically-rotated plate, if an electrically-rotate plate is adopted as the rotary plate 2345, the rotary plate 2345 is electrically connected with the power cable 4000; according to this embodiment, the at least two layers of rotary plates 2345 respectively installed at the portion of the central post 100 defined above the first layer of table surface 1 and at a proper location on the central post 100 defined above the lower layer of rotary plate forms a five layer structure, in other words, a second layer of rotary plate 2 having a through hole 20 and installed above the first layer of table surface 1, and a third layer of rotary plate 3 having a through hole 30 and installed above the second layer of rotary plate 2, meanwhile the anti-slip pad 23453 and the plural partition boards 23455 and the safety protection rail 23454 at the periphery are optionally installed on the third layer of rotary plate 3, and plural grids are formed by the plural partition boards 23455, and a fourth layer of rotary plate 4 having a through hole 40 and installed above the third layer of rotary plate 3, and a fifth layer of rotary plate 50 having a through hole 50 and installed above the fourth layer of rotary plate 4, what shall be address is that the provided arrangement means is only served for illustration, the actual number of layers can be increased or decreased with respect to the actual requirement.

Figure 4:
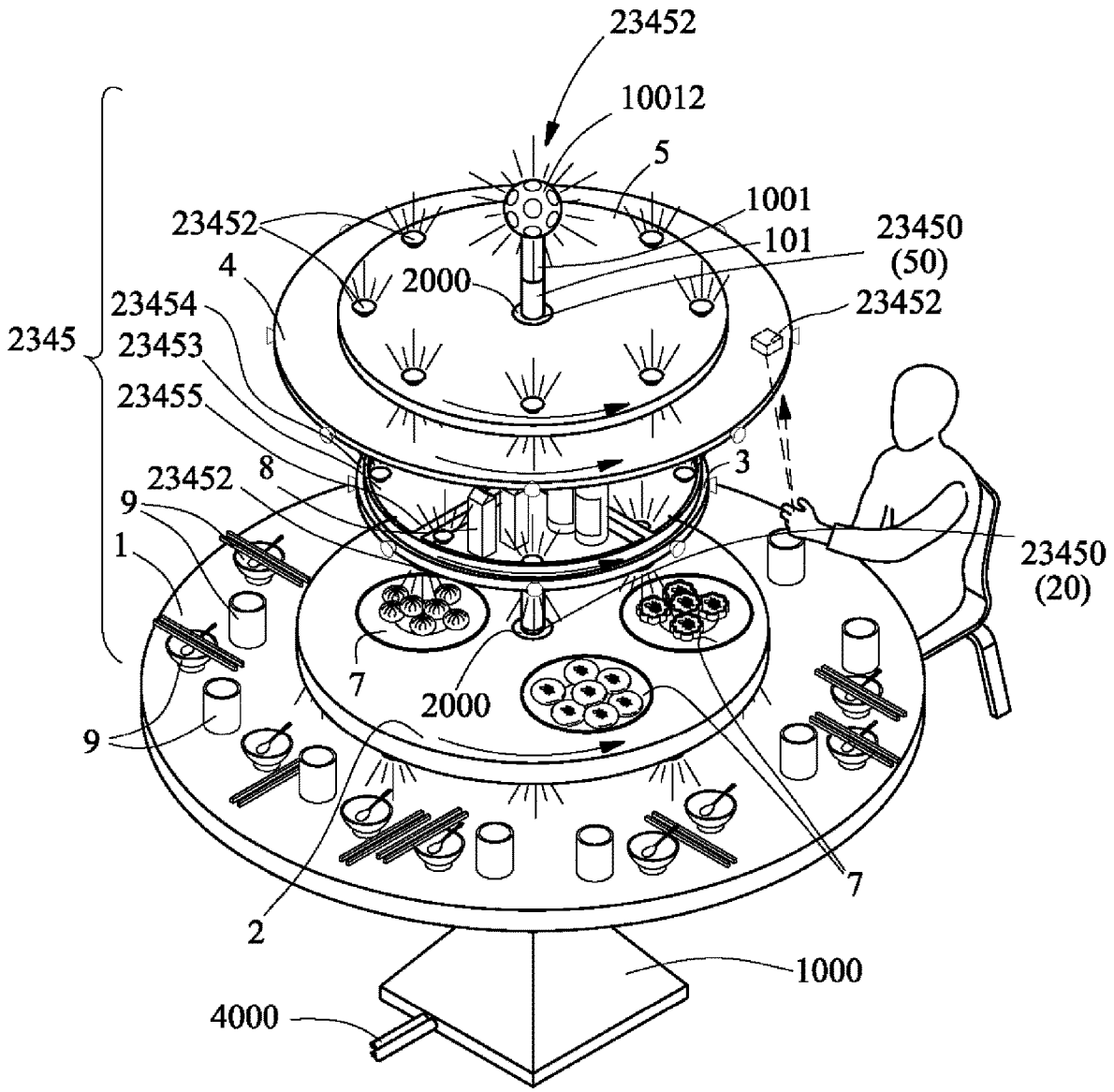
FIG. 4 is a perspective view illustrating the rotary plates and the guest getting food according to the present invention.

The power sensor 23451 is optionally installed at the bottom of the rotary plate 2345 and connected with the power cable 4000, when a guest wants to get food, the rotary plate 2345 adopting the electrically-rotated plate is sensed and stopped (as shown in FIG. 4, which is a perspective view illustrating the rotary plates and the guest getting food according to the present invention), according to this embodiment, the power sensor 23451 is an infrared power sensor, what shall be addressed is that the infrared power sensor is adopted for illustration and other sensors providing similar function shall all be within the scope of the present invention.

The plural illumination units 23452 are connected with the power cable 4000 and optionally installed on the top or the bottom or both of the top and the bottom or the periphery of the rotary plate 2345 or the head portion 1001 of the central post 100, for providing illumination on dishes or providing a light changing effect for decoration or projection, according to this embodiment, the illumination unit 23452 is a LED lamp, what shall be addressed is that the LED lamp is only adopted for illustration and other illumination units are all within the scope of the present invention. Furthermore, according to the present invention, the illumination unit 23452 installed on the head portion 1001 of the central post 100 can be formed in a spherical shape 10012, the interior thereof is installed with a motor 10013 thereby enabling the illumination unit 23452 formed in the spherical shape 10012 to rotate; furthermore, the illumination unit 23452 formed in the spherical shape 10012 can be a laser projecting lamp or marquee for providing special effects (as shown in FIG. 5, which is a perspective view illustrating the head portion being installed with the illumination unit formed in the spherical shape and the dinner wares and the cold and the cooked food according to the present invention); furthermore, the head portion 1001 of the central post 100 can not only be installed with the illumination unit 23452, the head portion 1001 of the central post 100 can also be installed with a name label 10011 (as shown in FIG. 6, which is a perspective view illustrating the head portion being installed with the name label and the dinner wares and the cold and the cooked food according to the present invention), the name label 1011 can be written with the name of the person who is celebrating his/her birthday or the names of the groom and the bride with respect to various social occasions.

Figure 5:
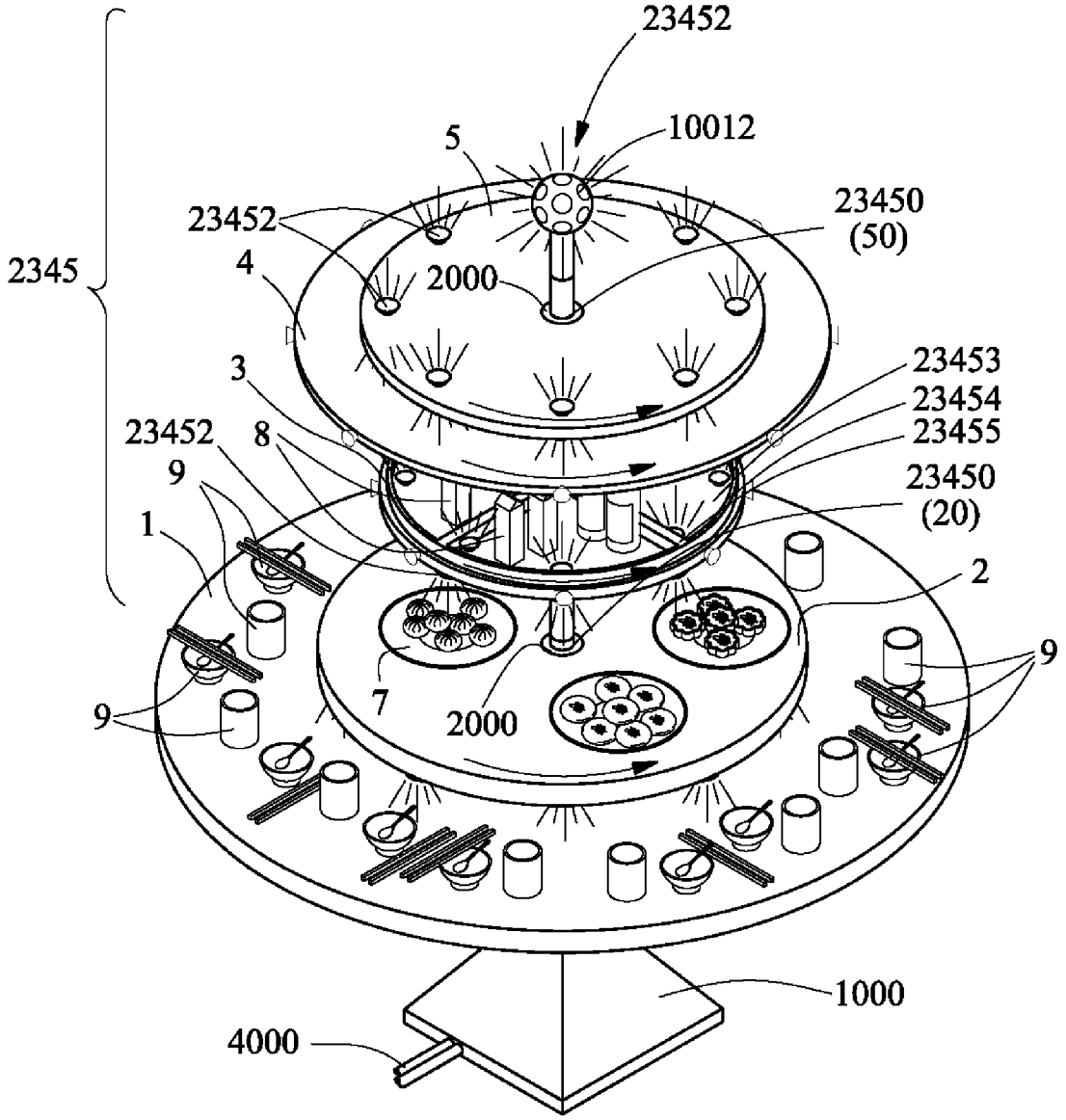
FIG. 5 is a perspective view illustrating the head portion being installed with the illumination unit formed in the spherical shape and the dinner wares and the cold and the cooked food according to the present invention.
Figure 6:
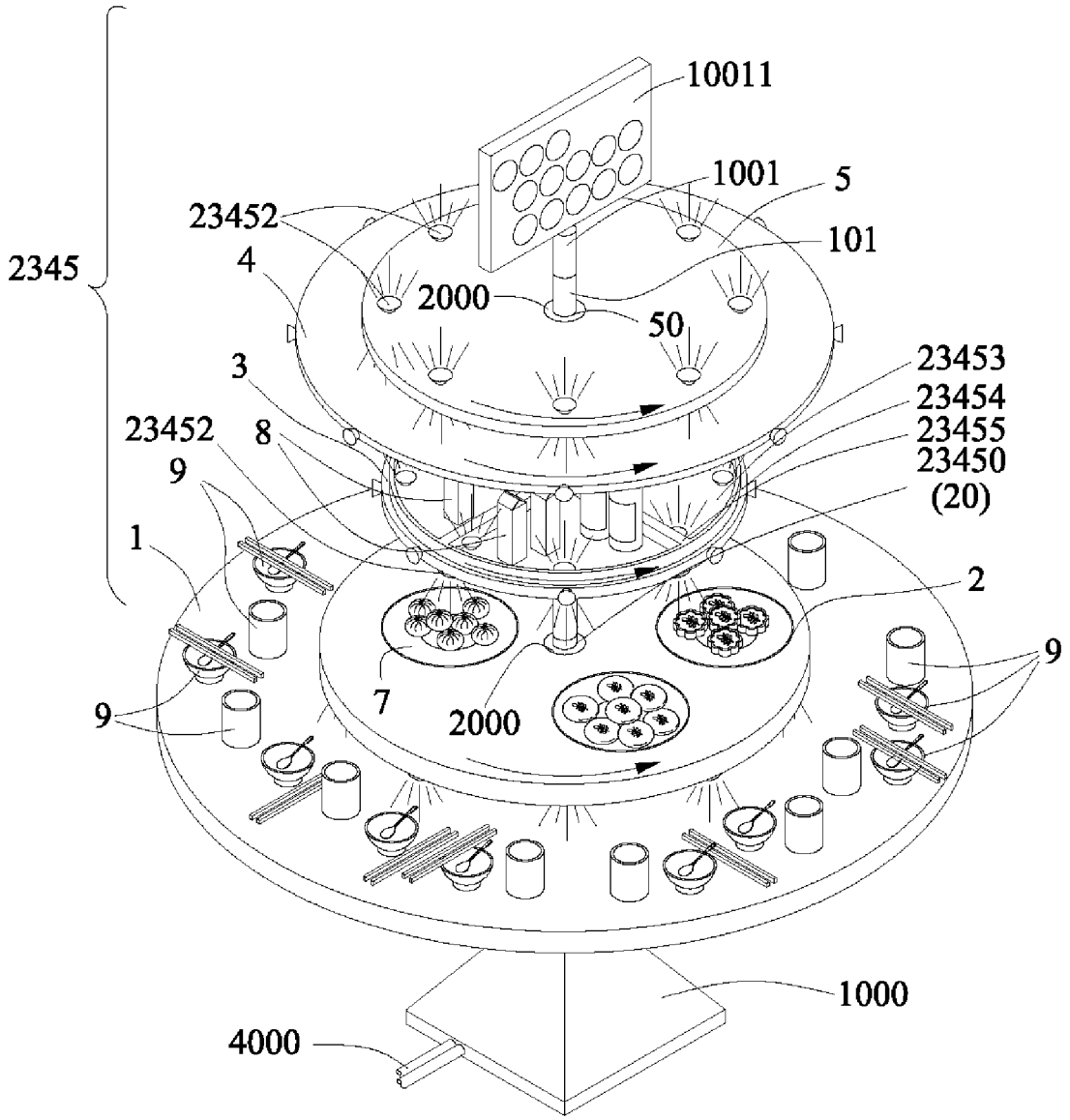
FIG. 6 is a perspective view illustrating the head portion being installed with the name label and the dinner wares and the cold and the cooked food according to the present invention.

With the improved table structure provided by the present invention (as shown in FIG. 5), cool food 8 such as liquor, juices and soft drinks and the cooked food 7 placed on the first layer of table surface 1 can be separately placed on different layers of rotary plates 2345, so the dining wares 9 and the cold and cooked food 8, 7 do not have to be all placed on the first layer of table surface 1 and the second layer of rotary plate 2, in other words, the cold food 8 such as liquor, juices and soft drinks is placed on the third layer of rotary plate 3, according to this embodiment, the third layer of rotary plate 3 is optionally installed with the anti-slip pad 23453 and the plural partition boards 23455 and the safety protection rail 23454 at the periphery, thereby providing effects of anti-slip and safety for placing the cold food 8 such as liquor, juices and soft drinks, and the assembly can be detached at any desired time, so the first layer of table surface 1 and the second layer of rotary plate 2 are provided with more unoccupied space, thereby preventing the dining wares 9, the cold and cooked food, 8, 7 from being crowdedly arranged against each other which may causes accidents such as items falling; according to this embodiment, the bottom of the second layer of rotary plate 2 is installed with the illumination unit 23452, and above the second layer of rotary 2, the illumination unit 23452 can be installed at the top or the bottom or both of the top and the bottom or the periphery according to the user's desire for providing illumination to the cold and cooked food 8, 7 or providing the light changing effect and increasing the freshness looking of the cold and the cooked food, 8, 7 and decoration, and the at least two layers of rotary plates 2345 can be detached at any desired time with respect to the loaded weight through the sleeve ring 2000 or the roller 3000 (as shown in FIG. 1) thereby saving labor for operating, and the top and the bottom of the central post 100 are installed with the power cable 4000 for being connected to a power source from the ceiling 5000 or the floor 6000, and the bottom of the rotary plate 2345 above the second layer can be optionally installed with the infrared power sensor 23451, the rotary plate 2345 installed below can be sensed and automatically stopped when guests want to get foods (as shown in FIG. 4), thereby effectively increasing the convenience in use, novel in design, and practical in application.

As what has been disclosed above, the present invention is novel and the technical characteristic of this invention has not been published or used in public, so the technical characteristic disclosed in the present invention is not an art that is well known by skilled people. Moreover, the present invention can effectively solve the shortages existed in prior art and can satisfy the needs required by users and consumers, so it is known that the present invention cannot be invented without innovation and technical improvement. Thus, the present invention has complied with the element of novelty and non-obviousness for patentability.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific examples of the embodiments disclosed and that modifications and other embodiments are intended to be included within the scope of the appended claims. Although specific terms are employed herein, they are used in a generic and descriptive sense only and not for purposes of limitation. Although the present invention has been described with reference to the foregoing preferred embodiment, it will be understood that the invention is not limited to the details thereof. Various equivalent variations and modifications can still occur to those skilled in this art in view of the teachings of the present invention. Thus, all such variations and equivalent modifications are also embraced within the scope of the invention as defined in the appended claims.

What is claimed is:

1. An improved table structure, comprising:

a central post, formed as a straight post, and a top thereof being formed with a head portion, the central post being composed by plural insertion posts, the top of the insertion post being formed with a protrusion part allowing an adjacent insertion post to be inserted and connected, the interior of the insertion post and the protrusion part being respectively formed with a penetrated through hole, and a power cable being provided inside the central post thereby being enabled to be connected to a power source form the top or the bottom;

a table stand, installed at the bottom of the central post, and formed in a gradually expanded state;

a first layer of table surface, fastened at a proper location on the central post, and the center thereof being formed with a through hole; and at least two layers of rotary plates, respectively installed at the portion of the central post defined above the first layer of table surface and at a proper location on the central post defined above the lower layer of rotary plate, the center of the rotary plate being formed with a through hole corresponding to the insertion post, wherein the rotary plate is optionally installed with an anti-slip pad, wherein the interior of the through hole formed at the center of the rotary plate is installed with a sleeve ring or a roller, the rotary plate is an electrically-rotated plate electrically connected to the power cable of the central post, and the bottom of the rotary plate is installed with at least a power sensor which is connected to the power cable, thereby providing an automatic sensing and stopping function to the electrically-rotated plate when a person reaches for a food.

2. The improved table structure according to claim 1, wherein the rotary plate is optionally installed with plural partition boards and installed with a safety protection rail at the periphery.

3. The improved table structure according to claim 1, wherein the rotary plate is a manually-rotated plate.

4. The improved table structure according to claim 1, wherein the power sensor is an infrared power sensor.

5. The improved table structure according to claim 1, the plural illumination units are connected with the power cable and optionally installed on the top or the bottom or both of the top and the bottom or the periphery of the rotary plate or the head portion of the central post.

6. The improved table structure according to claim 5, wherein the illumination unit installed at the head portion of the central post is formed in a spherical shape having a motor therein for providing a rotating function.

7. The improved table structure according to claim 1, wherein the head portion of the central post is installed with a name label.

* * * * *